US005455664A

United States Patent [19]

Ito et al.

[11] Patent Number: 5,455,664

[45] Date of Patent: Oct. 3, 1995

[54] ELECTROPHOTOGRAPHIC PRINTER FOR TRANSFERRING IMAGES ON DIFFERENT SIZED PRINT MEDIUM AND TRANSFERRING METHOD OF THE SAME

[75] Inventors: Katsuyuki Ito; Shinichi Katakura; Koichi Matsuzaki; Toru Ishihara, all of Tokyo, Japan

[73] Assignee: Oki Electric Industry Co., Ltd., Tokyo, Japan

[21] Appl. No.: 67,121

[22] Filed: May 26, 1993

[30] Foreign Application Priority Data

May 27, 1992 [JP] Japan ..... 4-134592

[51] Int. Cl.[6] ..... G03G 15/14; G03G 21/00

[52] U.S. Cl. ..... 355/277; 355/208; 355/273; 355/311

[58] Field of Search ..... 355/271, 273, 355/274, 311, 208, 275, 277; 346/160; 347/224, 140, 238; 361/212, 213, 214, 220, 221, 225, 229

[56] References Cited

U.S. PATENT DOCUMENTS

| | | | |
|---|---|---|---|
| 4,382,674 | 5/1983 | Miyoshi et al. | 355/311 |
| 4,733,269 | 3/1988 | Kasahara et al. | 355/271 X |
| 5,099,287 | 3/1992 | Sato | 355/274 |
| 5,361,088 | 11/1994 | Ito et al. | 346/160 X |

FOREIGN PATENT DOCUMENTS

| | | |
|---|---|---|
| 59-40674 | 3/1984 | Japan . |
| 63-291073 | 11/1988 | Japan . |
| 1-201686 | 8/1989 | Japan . |
| 2-123385 | 5/1990 | Japan . |
| 4-084181 | 3/1992 | Japan . |
| 4-128857 | 4/1992 | Japan . |

*Primary Examiner*—A. T. Grimley
*Assistant Examiner*—Shuk Y. Lee
*Attorney, Agent, or Firm*—Spencer, Frank & Schneider

[57] ABSTRACT

In an electrophotographic printer, a power supply is connected to a transfer roller to which a current is supplied at a time that a print paper is inserted between a photosensitive drum 10 and the transfer roller. Since respective print papers have different resistances from one another, a voltage according to the kind of the print paper is generated at the transfer roller at a time that a preset current is supplied to the transfer roller, and is held. A sensor is arranged for detecting the width of the print paper, and detects the width of the print paper inserted between the photosensitive drum and the transfer roller. The value of the preset current supplied to the transfer roller 14 is changed so as to adapt to the width of the print paper.

10 Claims, 3 Drawing Sheets

ELECTROPHOTOGRAPHIC PRINTER FOR TRANSFERRING IMAGES ON DIFFERENT SIZED PRINT MEDIUM AND TRANSFERRING METHOD OF THE SAME

BACKGROUND OF THE INVENTION

1. Field of the Invention

This invention relates to an electrophotographic printer including a contact type transferring mechanism.

2. Description of Related Art

Electrophotographic printers are conventionally formed to contact a photosensitive drum carrying a toner image on its surface with a transfer roller applied with a voltage for attracting the toner and to rotate them, thereby transferring the toner image onto a print paper by inserting the print paper between the photosensitive drum and the transfer roller. In such an electrophotographic printer, the transfer roller is formed with a rubber material having the resistance around $10^8$ Ω-cm and covering a conductive shaft, to which a voltage of the polarity opposed to that of the toner is applied. When the print paper is inserted between the photosensitive drum and the transfer roller, a power supply for a transferring mechanism conducts a constant current control in which a constant amount of current is applied to the conductive shaft, thereby holding the voltage generated by the current. After the print paper is inserted between the photosensitive drum and the transfer roller, or during the transfer operation, the power supply then conducts a constant voltage control using the already held voltage. This control allows the electrophotographic printer to correspond to the resistive variance of the transfer roller due to environmental changes.

However, since the conductive shaft is controlled to receive the constant current when the print paper is inserted and the shaft holds the voltage generated through the constant current control, even if the resistance of the inserted print paper is changed, such a conventional electrophotographic printer can not adjust the generated voltage to the changes of the resistance. Therefore, the transfer efficiency of the electrophotographic printer may be lowered in conjunction with quality, thickness, size and the like of the print papers. For example, if the print paper has a narrow width, the resistance of the outside of the edge of the print paper becomes lower than the resistance via the paper because the photosensitive drum and the transfer roller directly contact with each other at the outside of the edge. Accordingly, even if the power supply conducts the constant voltage control by holding the voltage generated by the constant current control, current may go around the paper at the transfer roller, so that the current that should to flow through the print paper may flow into a portion of the transfer roller not contacting the print paper. Hence, in the case when the conventional electrophotographic printer prints on envelopes and the like, whose width is narrow and whose resistance is high, the transfer efficiency of the printer may be lowered.

SUMMARY OF THE INVENTION

It is an object of the invention to provide an electrophotographic printer capable of obtaining a stable transfer efficiency against various kinds of transfer materials by solving the problems in the conventional electrophotographic printer.

The foregoing object is accomplished with an electrophotographic printer including a transfer roller, in pressing contact with a photosensitive drum, for transferring a toner image on the photosensitive drum onto a print paper conveyed. A power supply is connected to the transfer roller, and sets, at the time that the print paper is inserted between the photosensitive drum and the transfer roller, a current value supplied to the transfer roller. A sensor is provided for detecting the width of the print paper. This sensor detects the width of the print paper inserted between the photosensitive drum and the transfer roller, and thereby the power supply changes the current value supplied to the transfer roller in accordance with the detected width of the print paper.

BRIEF DESCRIPTION OF THE DRAWINGS

The above and other objects and features of the invention are apparent to those skilled in the art from the following preferred embodiment thereof when considered in conjunction with the accompanied drawings, in which.

DETAILED DESCRIPTION OF THE PREFERRED EMBODIMENT

Figure 1:
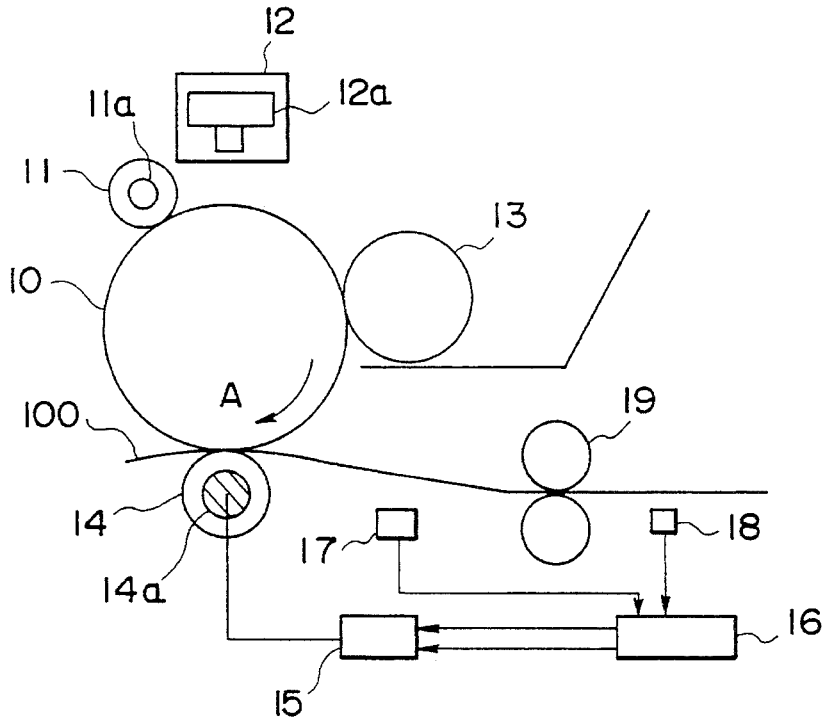
FIG. 1 is a schematic diagram illustrating an electrophotographic printer according to a preferred embodiment of the invention.

Referring to the drawings in detail, in particular, to FIG. 1, an electrophotographic printer according to a preferred embodiment of the invention is shown. In FIG. 1, a photosensitive drum 10 is formed by disposing photosensitive material, such as a selenium photoconductor, organic photoconductor (OPC), zinc oxide photoconductor, amorphous silicon photoconductor, or the like, around a conductive supporter, and rotates in a direction indicated by arrow A. A charging roller 11 rotates in contact with the photosensitive drum 10, thereby uniformly charging the surface of the photosensitive drum 10. The charging roller 11 is formed by disposing, for example, conductive rubber around a surface of a conductive shaft 11*a* made of stainless steel or the like. A power supply, not shown, connects to the conductive shaft 11*a* to apply voltage to the charging roller 11. The surface of the photosensitive drum 10 is radiated by an exposing device 12 constituted of an LED array head 12*a*, and this exposing process provides an electrostatic latent image on the surface of the photosensitive drum. Laser devices or the like, in addition to the LED array head 12*a*, can be used as the exposing device. The electrostatic latent image formed on the photosensitive drum 10 is conveyed to a developing device, at which a toner image is formed by developing with a developing roller 13. The developing roller 13 contacts, or is spaced a small distance from, photosensitive drum 10. The developing roller 13 makes toner adhere thereon and conveys the toner, and thereby developing the electrostatic latent image on the photosensitive drum 10. For example, in the case of a reversal development, a bias potential is applied between the conductive supporter of the photosensitive drum 10 and the developing roller 13. Then, between the developing roller 13 and the photosensitive drum 10, electric field lines are formed by the electrostatic latent image on the photosensitive drum 10. Therefore, the charged toner on the developing roller 13 is attracted and adheres to the photosensitive drum 10 by electrostatic force, so that a toner image visualizing the electrostatic latent image is formed on the photosensitive drum 10. Any of a two component magnetic brush developer, a one component brush developer, a one component non-magnetic developer and the like, in addition to the developing roller 13, can be used as the developing device.

On the other hand, a transfer medium, or print paper 100, being contained in a paper cassette not shown, is taken out by a paper supply roller (not shown) sheet by sheet. The print paper 100 runs into a register roller 19, which is forced to cease rotating, to get rid of a skew of the paper. A transfer roller 14 is rotated with a speed such that the peripheral velocity ratio of the photosensitive drum to the transfer roller is 1:1, so that no relative speed difference occurs between them. The transfer roller 14 is pressed in contact with the photosensitive drum 10, and when the print paper 100 is inserted between them, the transfer roller 14 transfers a toner image on the photosensitive drum 10 onto the print paper 100. The transfer roller 14 is constituted by a roller covered with a rubber material such as a foamed elastic body, and is formed so that electric resistance between the conductive shaft 14*a* and the photosensitive drum 10 is set in a range of $10^5$ to $10^8$ (Ω). A high voltage power supply 15 is connected to the conductive shaft 14*a* to apply a certain voltage to the transfer roller 14.

Figure 2:
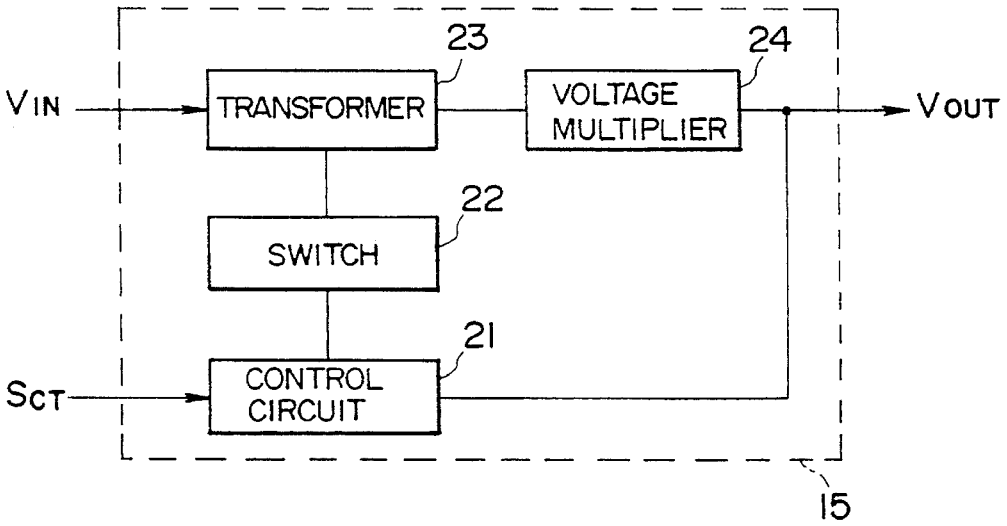
FIG. 2 is a block diagram showing a high voltage power supply of the electrophotographic printer of FIG. 1.

A controller 16 receives inputs from a print paper input sensor 17 and a print paper width sensor 18, and sends a command to the high voltage power supply 15, thereby controlling the voltage applied to the conductive shaft 14*a* of the transfer roller 14. FIG. 2 shows a block diagram of the high voltage power supply 15. A control circuit 21 receiving control signal $S_{CT}$ from the controller 16 controls input voltage $V_{in}$ supplied to the transformer 23 through a switch element 22. Output voltage outputted from the transformer 23 is raised to a suitable voltage by a voltage multiplier 24 and is outputted as a high output voltage $V_{out}$.

Then, the print paper 100 is conveyed by a fixing device constituted of a pressure roller and a heating roller, not shown. Heat from the heating roller fuses the toner, and pressure by the pressure roller impregnates the toner among fibers of the print paper 100, so that the toner is fixed on the print paper 100. The print paper 100 with the fixed toner is conveyed out of the printer through a delivery roller (not shown). In the meantime, although a bit of toner may stay on the photosensitive drum 10 after being used for transferring, it is cleaned away by a cleaner not shown. The photosensitive drum 10 is used repeatedly in a manner described above. The register roller 19 is a roller for conveying the print paper 100, and is driven to rotate by a drive motor (not shown). A main motor (not shown) drives the photosensitive drum 10, the charging roller 11, the developing roller 13, and the transfer roller 14.

Figure 3:
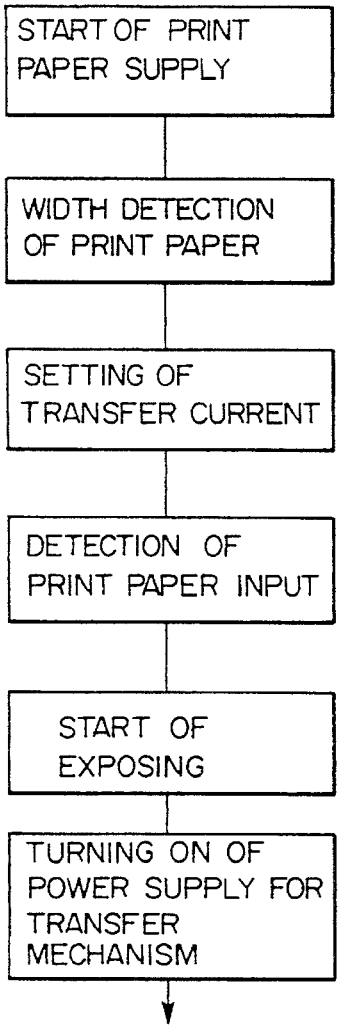
FIG. 3 is a control flow of the electrophotographic printer according to the invention.
Figure 4:
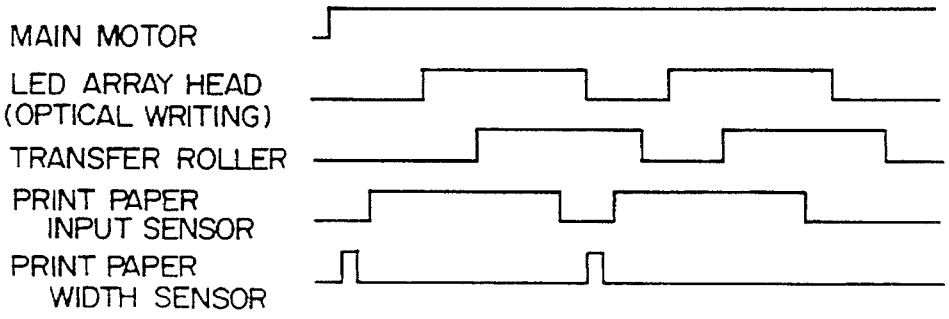
FIG. 4 is a time chart of the electrophotographic printer according to the invention.

FIG. 3 is a flow chart indicating operations of the electrophotographic printer, and FIG. 4 is a time chart.

The photosensitive drum 10, shown in FIG. 1, is rotated by drive power of the main motor, and the print paper 100 contained in a paper cassette (not shown) is taken out by the print paper supply roller (not shown). The print paper 100 taken out runs into the ceasing register roller 19 to get rid of any skew of the paper. The print paper passes by the print paper width sensor 18. At that time the width of the print paper is detected by the print paper width sensor 18, and is indicated to the controller 16. The print paper width sensor 18 is formed by arranging a plurality of photo-couplers in a row, and is capable of distinguishing at least two of widths of the print paper 100 to recognize different kinds of the print papers 100. According to the detected kind of the print paper 100, the controller 16 sets a current value for the constant current control.

Next, when the drive motor (not shown) drives to rotate the register roller 19, the print paper 100 passes by the print paper input sensor 17, and is then inserted between the photosensitive drum 10 and the transfer roller 14. When the print paper 100 passes by the print paper input sensor 17, the signal of the print paper input sensor 17 rises, or goes true, and then the LED array head 12*a* exposes, the photosensitive drum 10 to start optical-writing.

After the signal of the print paper input sensor 17 rises, the controller 16 measures a certain time. This certain time gives timing for inserting the print paper 100 between the photosensitive drum 10 and the transfer roller 14. When the certain time is passed, the controller 16 recognizes that the print paper 100 is inserted between the photosensitive drum 10 and the transfer roller 14, and the controller 16 controls to turn on the high voltage power supply 15.

When a certain time is passed after the signal of the print paper input sensor 17 is down, or goes false, the controller 16 recognizes that the print paper 100 has already passed between the photosensitive drum 10 and the transfer roller 14, and the controller 16 controls to turn off the high voltage power supply 15.

Figure 5:
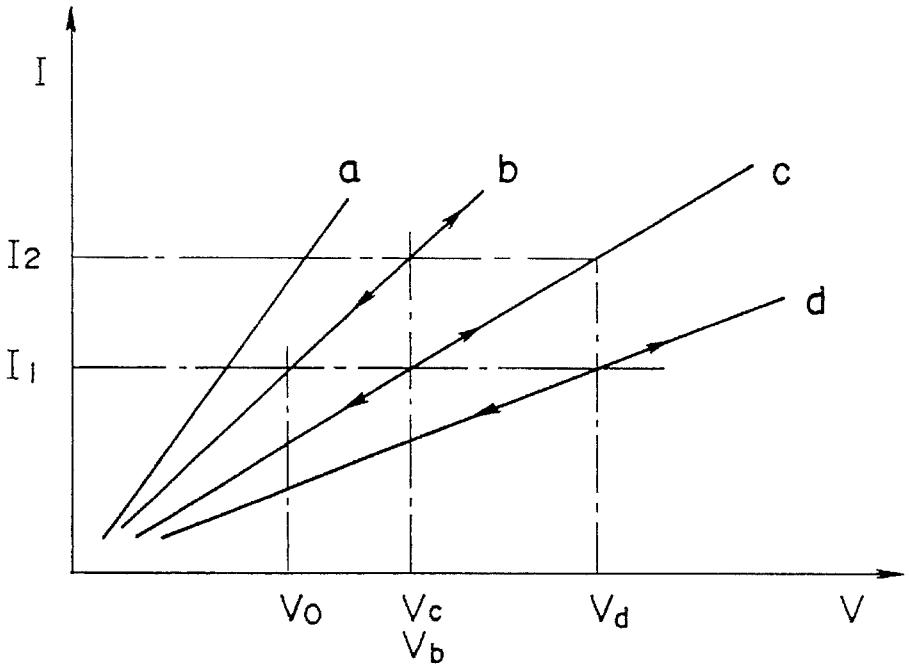
FIG. 5 is a diagram showing a number of V-I characteristics used for setting voltage applied to a transfer roller of the electrophotographic printer according to the invention.

FIG. 5 is a diagram of V-I characteristics for setting a voltage applied to the transfer roller. In the case that a voltage is applied to the transfer roller 14 shown in FIG. 1, impedance of the load in conjunction with the high voltage power supply 15 is varied according to electric charges left over at the transfer roller 14, the print paper 100, and the photosensitive drum 10. That is, the transfer roller 14 has the V-I characteristics has by line a in the case when the print paper 100 is not inserted between the photosensitive drum and the transfer roller 14, and as shown by lines b, c, and d in the case when the print paper 100 is inserted between the photosensitive drum and the transfer roller 14. More specifically, in the case when the print paper 100 is a normal paper and has almost the same width as the transfer roller 14, the transfer roller 14 has the V-I characteristics shown by line c. In the case when the print paper 100 is a highly resistive paper such as a cardboard, a sheet for overhead projectors (OHP), and the like, the transfer roller 14 has the V-I characteristics shown by line d. In the case when the print paper 100 has a narrow-width envelope, and the like, the transfer roller 14 has the V-I characteristics shown by line b. On each line, a bold line portion indicates the range of suitable transfer efficiency. When the width of the print paper 100 is the same as that of the transfer roller 14, if a constant current control is conducted so that a predetermined current value $I_1$ is supplied to the conductive shaft 14*a*, voltages $V_c$, $V_d$ are generated in accordance with the kind of print paper 100. A desirable transfer efficiency can therefore be obtained by a constant voltage control through holding those generated voltages $V_c$, $V_d$.

Figure 6:
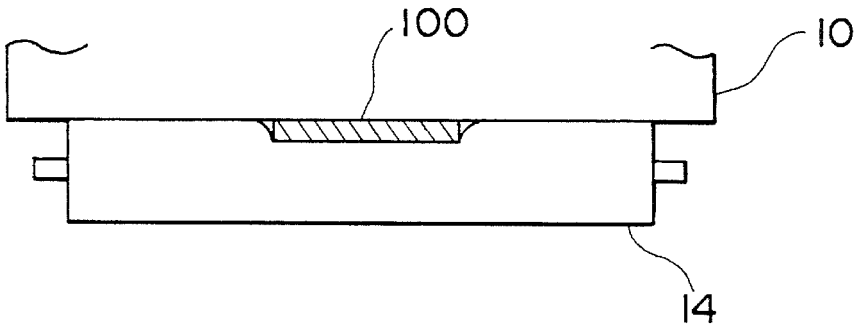
FIG. 6 is a side view of the electrophotographic printer of FIG. 1 at a time that a narrow-width print paper is inserted.

Next, operation in the case when the print paper 100 has a narrow width will be described below. FIG. 6 is a side view of the electrophotographic printer at a time that a narrow-width print paper is inserted. Since the print paper 14 and the photosensitive drum 10 are directly in contact with each other at a portion that the print paper 100 is not inserted, the V-I characteristics of this case is indicated by line b of FIG. 5, and approaches the V-I characteristics of line a. The voltage $V_0$ generated from the current of value $I_1$ becomes lower than the voltage $V_c$, so that the transfer efficiency of this case goes out of the desirable range as shown in FIG. 5.

In order to avoid such a problem, when the print paper 100 has a narrow width, a predetermined current is changed from value $I_1$ to value $I_2$ in the constant current control, and thereby voltage $V_b$ ($=V_c$) is controlled to be generated at a time that the print paper 100 is inserted between the photosensitive drum 10 and the transfer roller 14. According to this control, even when the print paper 100 has a narrow width, the voltage $V_b(=V_c)$ which is the same as the voltage at a time when print paper 100 has almost the same width as the transfer roller 14, can be applied, so that a desirable transfer efficiency can be obtained.

More specifically, the print paper width sensor 18 of FIG. 1 first detects the width of the print paper 100. Receiving the detected signal from the sensor 18, the controller 16 then outputs a command to the high voltage power supply 15, and thereby the current preset in the constant current control is changed to suitable value $I_2$. The voltage $V_b$ generated through the constant current control by the current $I_2$ is held and used for a constant voltage control.

It is to be noted that in the case where the print paper width sensor 18 is capable of detecting a plurality of widths of the print papers 100, the controller 16 can preferably set a plurality of current values.

As described above, in the electrophotographic printer according to the invention, the constant voltage control operates after the print paper 100 is inserted between the photosensitive drum 10 and the transfer roller 14, and therefore, even if the resistance of the print paper 100 changes, the voltage applied to the transfer roller 14 is changed according to changes of the resistance. Accordingly, even if printing on an envelope having narrow-width and high resistance, the printer can print with sufficiently high transfer efficiency.

It is understood that although the present invention has been described in detail with respect to preferred embodiments thereof, various other embodiments and variations are possible to those skilled in the art which fall within the scope and spirit of the invention, and such other embodiments and variations are intended to be covered by the following claims.

What is claimed is:

1. An electrophotographic printer having a contact type transferring mechanism, comprising:

(a) a photosensitive drum;

(b) a transfer roller for transferring a toner image on said photosensitive drum onto a conveyed print medium, said transfer roller being in pressing contact with said photosensitive drum;

(c) current supply means for supplying a predetermined constant current to said transfer roller;

(d) holding means for holding a voltage generated at said transfer roller at a time when said print medium is inserted between said photosensitive drum and said transfer roller, the voltage generated at said transfer roller being determined by a resistance of said print medium;

(e) a sensor for detecting a width of said print medium inserted between said photosensitive drum and said transfer roller and outputting a signal corresponding to the detected width; and (f) changing means for changing current value supplied by said current supply means, in accordance with said signal from said sensor.

2. An electrophotographic printer as set forth in claim 1, wherein said sensor is formed from a plurality of photocouplers.

3. A transferring method of an electrophotographic printer having a contact type transferring mechanism, comprising the steps of:

(a) detecting a passing print medium with a sensor;

(b) counting up to a predetermined time from detection of said passing print medium at said sensor to insertion of said print medium between a photosensitive drum and a transfer roller;

(c) supplying a current to said transfer roller after said predetermined time is counted up;

(d) holding a voltage generated at said transfer roller by said current from current supply means.

4. A transferring method as set forth in claim 3, further comprising the steps of;

(a) detecting a width of said print medium inserted between said photosensitive drum and said transfer roller; and (b) changing current value supplied by said current supply means, in accordance with the detected width of said print medium.

5. A electrophotographic printer having a contact type transferring mechanism, comprising:

(a) a photosensitive drum;

(b) a transfer roller for transferring a toner image on said photosensitive drum onto a conveyed print medium, said transfer roller being in pressing contact with said photosensitive drum;

(c) current supply means for supplying a predetermined constant current to said transfer roller;

(d) holding means for holding a voltage generated at said transfer roller at a time when said print medium is inserted between said photosensitive drum and said transfer roller, the voltage generated at said transfer roller being determined by a resistance of said print medium, wherein the holding means adjusts the voltage generated at the transfer roller based on a width of the print medium.

6. An electrophotographic printer comprising:

a photosensitive drum;

a transfer roller, in contact with the photosensitive drum, for transferring a toner image on the photosensitive drum to a print medium conveyed between the transfer roller and the photosensitive drum;

a current supply device, coupled to the transfer roller, for supplying a first constant current to the transfer roller for generating a first voltage at the transfer roller; and a voltage holding device, coupled to the transfer roller, for holding the first voltage constant when the print medium is conveyed between the transfer roller and the photosensitive drum, the first voltage generated at the transfer roller being determined by a resistance of the print medium; and a print medium width sensor for detecting a width of the print medium conveyed between the transfer roller and the photosensitive drum and generating a width signal coupled to the current supply device corresponding to the detected width of the print medium;

wherein, the current supply device is responsive to the width signal for supplying the first constant current when the width signal corresponds to a first predetermined print medium width and a second constant current when the width signal corresponds to a second predetermined print medium width.

7. The electrophotographic printer according to claim 6, wherein the print medium width sensor is formed from a photo-coupler.

8. A method for transferring an image in an electrophotographic printer, the printer transferring an image to a print medium using a contact type transferring mechanism between a photosensitive drum and a transfer roller, the method comprising the steps of:

sensing the print medium at a predetermined point along a print medium conveying path in the printer;

delaying a first predetermined period of time after the print medium is sensed at the predetermined point;

supplying a first constant current to the transfer roller after the first predetermined period of time has elapsed to generate a first voltage; and holding the first voltage at the transfer roller by the first current supplied to the transfer roller.

9. The method according to claim 8, further comprising the steps of:

detecting a width of the print medium; and supplying the first constant current to the transfer roller to generate the first voltage when the width of the print medium is detected to be a first predetermined width; and supplying a second constant current to the transfer roller to generate a second voltage when the width of the print medium is detected to be a second predetermined width.

10. The method according to claim 9, wherein the width of the print medium is detected by a plurality of photosensors.

* * * * *